United States Patent [19]

Henningsen et al.

[11] 4,163,220

[45] Jul. 31, 1979

[54] DISTRESS SIGNALLING DEVICE

[75] Inventors: Lee A. Henningsen; John E. Hare; David J. Amann, all of Erie, Pa.

[73] Assignee: Firetrol, Inc., Erie, Pa.

[21] Appl. No.: 787,822

[22] Filed: Apr. 15, 1977

[51] Int. Cl.[2] ..... G08B 5/38; H05B 41/24; H05B 41/34

[52] U.S. Cl. ..... 340/331; 250/199; 325/116; 325/115; 325/166; 340/345; 340/366 F

[58] Field of Search ..... 340/345, 332, 331, 321, 340/366 F, 332; 325/164, 166, 111, 115, 116; 250/199; 9/9, 8.3 E

[56] References Cited

U.S. PATENT DOCUMENTS

| | | | |
|---|---|---|---|
| 2,825,803 | 3/1958 | Newbrough | 340/366 F |
| 3,088,099 | 4/1963 | Du Vall | 340/345 |
| 3,181,135 | 4/1965 | Zoglio | 340/345 |
| 3,230,454 | 1/1966 | Van Burkleo | 325/166 |
| 3,475,619 | 10/1969 | Campbell | 340/345 |
| 3,668,684 | 6/1972 | Johnson et al. | 340/321 |
| 4,042,919 | 8/1977 | Patty | 340/105 |
| 4,124,842 | 11/1978 | Bachelor | 340/321 |

*Primary Examiner*—John W. Caldwell, Sr.
*Assistant Examiner*—James J. Groody
*Attorney, Agent, or Firm*—Allison C. Collard; Thomas M. Galgano

[57] ABSTRACT

An S-O-S distress signalling device for flashing a lamp, consisting of a decade binary counter, a signal converter circuit connected to the counter and a timer having its output coupled to the lamp and the input of the counter. The counter and converter circuits provide three charging paths to the timer, so that rapid flashes will be produced to simulate the "S" code and two charging paths to the timer to simulate the "O" code at a slower repetition rate. Between each S-O-S signal, only one charging path is provided, to slow down the timer to define the interval between the coded messages.

6 Claims, 2 Drawing Figures

Figure 1:
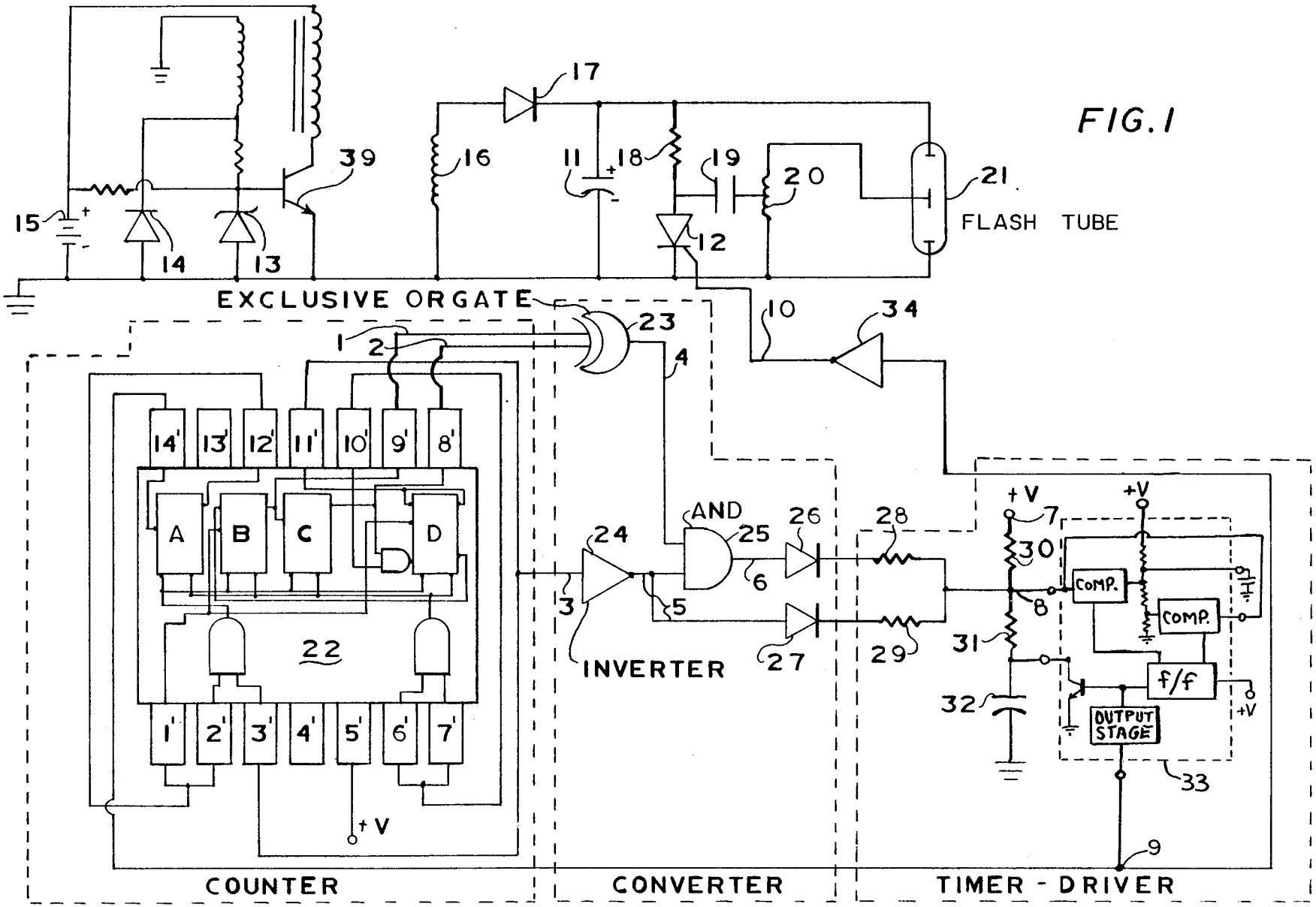

FLASH TUBE
TIMER - DRIVER
CONVERTER
INVERTER
COUNTER
EXCLUSIVE ORGATE
AND
COMP.
COMP.
f/f
OUTPUT STAGE
+V
A
B
C
D
22

DISTRESS SIGNALLING DEVICE

This invention relates to an electronic device for flashing a coded signal when connected to a gas-filled lamp.

More specifically, this invention relates to a Morse Code S-O-S signal-sending device, coupled to a zenon-type flashbulb.

In marine use, it has been customary to flash light signals across the surface of the water to adjoining vessels or to land areas for the purposes of sending coded messages. Where a vessel or craft has no radio and may be in a distressed condition, it is possible to flash Morse Code signals, such as in the form of the International Distress Signal S-O-S, by using the navigation lamps or a search lamp that is available to the vessel.

In prior art, such as in U.S. Pat. Nos. 3,205,487 and 3,142,052, there are disclosed portable S-O-S sending devices using incandescent lamps in combination with a search light. Generally, these devices utilize a motor-driven, printed circuit, which has three short, three long, and then three short conductor strips, which pass under a contact for each cycle of operation. These prior art devices require them to be directed by the user to a possible receiver and have a limited field of view and range.

In private and commercial vessels, new types of navigational lights are becoming available, which make use of xenon gas flash tubes, which are mounted on the top of a mast or highest point of the vessel, and are omnidirectional. These flash tubes emit an extremely bright and hi candle-power flash for a momentary period of time, and can be seen at great distances over the water. The xenon-type flashbulbs are presently being made available for marine vessels and are designed to periodically flash at night, to signal the presence of a vessel to other vessels in the adjoining area.

Accordingly, the present invention provides an improvement in distress signalling, using xenon flash-type lamps, and is capable of flashing the International Distress Signal S-O-S by delivering three short flashes, three flashes that are spaced apart for a longer duration or time interval, and again three short time interval flashes. It is not possible to ignite the xenon flash tube for more than a few milliseconds, without creating excessive temperatures in the bulb and destroying the bulb element, so that the flashes have to be spaced apart in time intervals, rather than being sustained in pulse width.

The device of the invention employs a coded, decimal decade counter in combination with a timer and suitable flash circuitry, so that the entire Morse Code Signal can be automatically sequenced and transmitted by the xenon tube when the circuit is actuated.

It is therefore an object, according to the present invention, to provide an International Distress Signal device, capable of sending a Morse Code S-O-S signal using electronic circuitry in combination with a flash-type tube.

It is another object, according to the present invention, to provide an International Distress Signaling device, which is simple in design, inexpensive in cost and reliable in operation.

Other objects and features of the present invention will become apparent from the following detailed description considered in connection with the accompanying drawing, which discloses the embodiments of the invention. It is to be understood, however, that the drawing is designed for the purpose of illustration only, and not as a definition of the limits of the invention.

Figure 2:
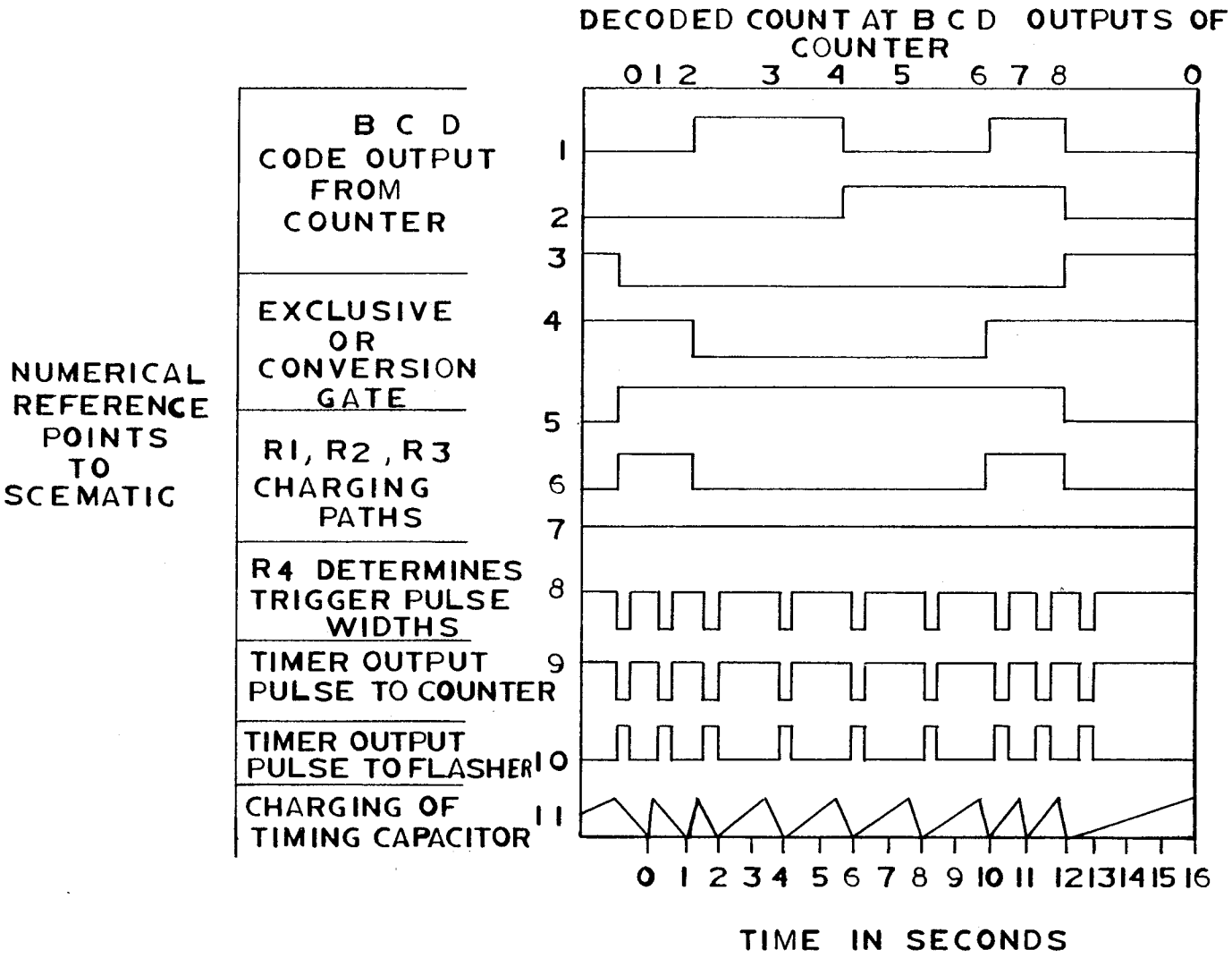

In the drawing:

FIG. 1 is a schematic diagram partly in block form, showing the operation of the Morse Code S-O-S distress sender according to the invention; and FIG. 2 shows the signal wave forms of the circuit of FIG. 1.

The circuit of FIG. 1 contains three major segments. There is a counter circuit 22, which feeds a converter circuit and a timer drive circuit 33. Counter circuit 22 is a binary coded decimal decade counter (BCD) having fourteen pin terminals designated as, 1'-14'. The BCD outputs 1', 2' and 3' of the counter are the inputs to the converter. The converter consists of an inverter 24, "AND" gate 25 and an exclusive "OR" gate 23, which convert the BCD outputs of the counter into a usable logic for the timer-driver circuit. Timer-driver circuit 33 consists of an astable timer, which is capable of providing an output frequency in accordance with the R/C network of the driver. It also provides the clock pulse to counter 22 and a pulse to trigger a flash tube 21.

The circuit of the invention employs a conventional battery-driven, high-voltage generator having a diode 14, zener diode 13, transistor 39 and transformer 16, in order to convert the low battery voltage to a high, secondary voltage, sufficient to flash the gas-filled flash tube. Counter 22 employs a decade counter which has four, dual-rank, master-slave flip-flops A, B, C, and D, internally interconnected to provide the digital counting. Gated, direct and reset lines are provided to inhibit count inputs and return all outputs to a logical "zero" or to a binary coded decimal (BCD) count of nine. As the output from the first flip-flop is not internally connected to the succeeding stages, the count may be separated into three, independent count modes. In the present case, the counter is employed as a binary coded decimal decade counter, with a symmetrical divide-by-ten count. The binary outputs of flip-flops B and C are connected to an exclusive "OR" gate 23, which has its output connected to one input of an "AND" circuit 25. The output of flip-flop D is connected through inverter 24 to the other input and "AND" gate 25 and to a diode 27. The output of "AND" gate 25 is connected through line 6 to diode 26. Both diodes are connected respectively to resistors 28 and 29, which are connected to an input terminal to timer 33. A supply voltage is provided through pin 8' of the timer, and an RC network is provided through resistors 28, 29, 30, 31 and capacitor 32, connected to the RC terminal of timer 33.

When power is applied to the circuit by battery 15, the secondary transformer winding at the output of the high voltage generator will produce an AC high voltage which is rectified by diode 17 so as to charge capacitor 11 to the desired level so that when SCR 12 is triggered into conduction, a flash tube 21 will flash at the desired brilliance.

At this point, the binary outputs 1, 2 and 3 of counter 22 are all at a low voltage magnitude. Line 4 at the output of exclusive "OR" gate 23 is high in voltage magnitude and line 5 at the output of inverter 24 is also high in magnitude. Line 6 at the output of "AND" gate 25 is high in magnitude. Terminal 7 at the input of timer 33 is high in voltage magnitude. Terminal 8 of the timer will go low in magnitude, and terminal 9 will also go low in magnitude. Terminal 10 at the output of inverter 34 or at the input of SCR 12 wil go high in magnitude.

Capacitor 32 will discharge to 0 volts through resistor 31. Terminals 8 and 9 will go high in magnitude, terminal 10 will go low in magnitude. The timer 33 at this point will charge very fast since all of its three charging paths are at high voltage magnitudes. This will cause voltage timing capacitor 32 to charge rapidly. As capacitor 32 charges to its threshold point, a sequence of events begins to happen. Terminal 8 goes low in voltage, terminal 9 goes low in voltage, and terminal 10 goes high in voltage. Terminal 9 injects a count into the counter and the output of inverter 34 on line 10 triggers the flasher through SCR 12. The flasher triggers through the output of SCR coupled through capacitor 19 and transformer winding 20 at the input of tube 21. This flash then become the second dot of the first "S" of the S-O-S code. Since terminal 8 has gone low in voltage, capacitor 32 will discharge through resistor 31 to terminal 8 and the threshold voltage will decrease to a low threhold point. At this time, terminal 8 will go high in voltage, and terminal 9 will go high in voltage, and line 10 will go low in voltage.

Timer 33 will then begin charging for the third dot of the first "S" in the code. As capacitor 32 reaches threshold voltage, input terminal 8 will go low, and terminal 9 will go low, line 10 will go high. Terminal 9, when it goes low, will inject another count into the counter, and line 10, at the output of inverter 34, will trigger the flasher. Line 1, at the output of counter 22, will go high in voltage, and line 4, at the output of gate 23, will go low in voltage, and line 6 will go low in voltage. The flash will produce the third dod of the first "S" in the S-O-S code.

Capacitor 32 begins discharging to a low threshold voltage through resistor 31 to terminal 8. At the low threshold voltage, terminal 8 will increase in voltage, and terminal 9 will also increase in voltage, and line 10 will drop in voltage. At this point, one of the charging paths to the timer, namely, line 4, is low so as to create a slower timing rate for the timer. This slower timing rate will produce a pause between the first "S" and the "O" in the S-O-S code. Capacitor 32 will charge to threshold level from only two paths, namely resistors R30 and R29. At this point, terminal 8 will go low, terminal 9 will go low, and line 10 will go high so as to trigger flasher 21. Point 9 will inject a count into counter 22 at terminal 14. Then capacitor 32 will begin to discharge to a low threshold voltage through resistor 31 to terminal 8. At the low threshold voltage, terminal 8 will go high, terminal 9 will go high, and line 10 will go low. This completes the first dash of the "O" in the S-O-S code.

Capacitor 32 will begin to charge to high threshold level through only two charging paths, so that it will continue to increase its charge at a slower rate. When it reaches its high threshold level, terminal 8 will go low and terminal 9 will go low, causing line 10 to go high to trigger flasher 21. At the same time, terminal 9 will inject a count into counter 22 at terminal 14 of the counter. Capaci-32 will begin to discharge through resistor 31 to terminal 8 to low threshold voltage. Terminals 8 and 9 will go high, and line 10 will go low. The second dash of the "O" of the S-O-S code has been completed.

Capacitor 32 will then charge to high threshold level through the two charging paths at a slow rate. When the threshold voltage is reached, terminals 8 and 9 will go low, and line 10 will go high in voltage. Terminal 9 will inject a count into counter 22 at terminal 14. Line 10 will trigger flasher 21, and capacitor 32 will discharge to a low threshold level through resistor 31 to terminal 8. Terminals 8 and 9 will go high, and line 10 will go low. The last dash of the "O" of the S-O-S code has been completed.

Capacitor 32 will then begin to charge to a high threshold voltage, again through two charging paths, creating a pause between "O" in the S-O-S code, and the last "S". At high threshold voltage, terminals 8 and 9 will go low, and line 10 will go high. Terminal 9 will inject a count into the counter, and line 10 will trigger flasher 21. Lines 1, 4 and 6 will go high, and capacitor 32 will discharge to a low threshold voltage through resistor 31 to terminal 8. Terminals 8 and 9 will go high and line 10 will go low. The first dot of the last "S" in the code has been completed.

Once again, three charging paths are established for the timer, so that it will charge at a faster rate. Capacitor 32 will charge to a high threhold voltage more rapidly, and with terminals 8 and 9 going low, line 10 will go high to again trigger the flasher 21. Terminal 9 will inject a count into the counter, and capacitor 32 will now discharge to a low threshold voltage through resistor 31 to terminal 8. Terminals 8 and 9 will go high and line 10 will go low. The second dot of the last "S" has been completed.

Capacitor 32 will begin to charge to high threshold voltage. At high threshold voltage, both terminals 8 and 9 will again go low, and line 10 will go high to trigger flasher 21. Terminal 9 will also inject a count into the counter. Terminals 8 and 9 will go high, and line 10 will go low. The last dot of the last "S" of the S-O-S code has been produced. Lines 1 and 2 are now low in voltage, and line 3 is high in voltage. Lines 5 and 6 are also low. The timer now has only one charging path for its capacitor, namely, through resistor 30. Capacitor 32 will charge very slowly to high threshold voltage. When high threshold voltage is reached, both terminals 8 and 9 will again go low, and line 10 will go high, and terminal 9 will inject a count into the counter, making the counter output binary 9. At binary 9, the counter will reset itself to binary zero through pins 2' and 3' of counter 22 which are the 'zero' sets. Because the counter has been reset, line 3 will go low, and lines 5 and 6 will go high, and capacitor 32 will discharge to a low threshold voltage through resistor 31 to terminal 8. Terminals 8 and 9 will go high, and line 10 will go low. The first dot of the first "S" in the next S-O-S code has just been completed.

FIG. 2 is a graph representing the time sequence with respect to resistors 28, 29, 30 and 31. The value selected were for a dot duration of one second a dash duration of two seconds with a pause duration of two seconds and a long pause of four seconds at the end of each S-O-S sequence.

In an actual embodiment of the invention, the high voltage generator selected could be any generator sufficient to charge capacitor 11 to the firing threshold voltage of flash tube 21.

The counter converter and timer driver circuits are preferably constructed from integrated circuits. For example, the counter used in the actual embodiment was a decade counter, such as Signetics Type S5490 or N7490, Timer circuit 33 can be Signetics Type NE555-/SE555, having two comparitors, a flip-flop and an output stage. The converter, which includes the exclusive "OR" gate 23, inverter 24 and "AND" gate 25 as well as diodes 26 and 27, can be purchased in a combination of integrated circuits which are well known in the art. Flash tube 21 is preferably a xenon flash tube, but any type of flash tube having high brightness would be desirable.

Pulses from timer 33 could also be used to modulate a remote radio transmitter, or a laser beam, used on boats, aircraft or space ships.

While only a single embodiment of the present invention has been shown and described, it will be obvious to those skilled in the art that many changes and modifications may be made thereunto without departing from the spirit and scope of the invention.

What is claimed is:

1. An apparatus for visual transmission of a coded S.O.S. distress signal through a high energy flash tube comprising:

a timer and driver circuit capable of producing a timed output signal in response to a charging signal applied to its input, said timer having its output coupled to the flash tube;

a binary coded decade counter having its input coupled to the output of said timer and driver circuit so as to advance the binary count;

converter means having its input coupled to the output of said decade counter and its output coupled to the input of said timer and driver circuit, said converter providing a parallel conductive charging path to said timer responsive to the binary output of the decade counter so as to lengthen or shorten the duration between the pulses produced at the output of said timer and driver circuit; and a high energy flash tube circuit coupled to another output of said timer and driver circuit for energizing the flash tube.

2. The apparatus as recited in claim 1 wherein said decade counter comprises four flip-flops connected in series whose outputs are incremented in a binary count code by the output of the timer and driver circuit closing the count loop, and said converter means comprises an exclusive "or" gate having its two inputs connected to the second and third of said flip-flops, and inverter having its input connected to the last of said flip-flops, an AND circuit coupled to the output of said exclusive "OR" gate and said inverter for producing a first charging input path to said timer and driver circuit, said inverter being coupled directly to said timer and driver to define a second charging path to said timer and driver circuit, and a fixed voltage source providing a third charging path to said timer and driver circuit.

3. The apparatus as recited in claim 2 wherein during the first three output pulses of the timer and driver circuit all three charging paths are coupled to the input of said timer and driver circuit so that three short duration flashes are produced by the flash tube, during the second three output pulses of the timer and driver circuit, only the inverter and fixed voltage source are coupled to said timer and driver direct so that three flashes are produced that are spaced apart a longer duration, and during the last three output pulses of the timer and driver circuit, all three charging paths are again connected to the timer and driver circuit so that three short duration flashes are produced.

4. The apparatus as recited in claim 3 wherein on the last count of said counter, only the fixed voltage source is connected to said timer and driver circuit to produce a longer pause before the beginning of the next S.O.S. cycle of operation.

5. The apparatus as recited in claim 4 additionally comprising a high voltage generator, a charging circuit coupled to the output of said generator, a semiconductor switch coupled between said charging circuit and the flash lamp, said semiconductor switch having its input trigger coupled to said timer and driver circuit.

6. The apparatus as recited in claim 4 wherein said timer and driver circuit includes an RC charging circuit coupled to the output of said converter means and fixed voltage source.

* * * * *